United States Patent [19]

Suzuki et al.

[11] 4,338,777

[45] Jul. 13, 1982

[54] METHOD AND APPARATUS FOR STARTING AND STOPPING AN OPEN END SPINNING MACHINE

[75] Inventors: Osamu Suzuki, Ohbu; Toshio Yoshizawa, Chiryu; Yoshiaki Yoshida, Ohbu; Keiji Onoue; Kazuo Seiki, both of Kariya, all of Japan

[73] Assignee: Kabushiki Kaisha Toyoda Jidoshokki Seisakusho, Kariya, Japan

[21] Appl. No.: 147,549

[22] Filed: May 5, 1980

[30] Foreign Application Priority Data

May 11, 1979 [JP] Japan ..... 54/56958

[51] Int. Cl.[3] ..... D01H 15/02; D01H 1/135

[52] U.S. Cl. ..... 57/263; 57/78

[58] Field of Search ..... 57/263, 58.89–58.95, 57/78–81

[56] References Cited

U.S. PATENT DOCUMENTS 3,334,479 8/1967 Mikulecky et al. ..... 57/263
3,354,626 11/1967 Cizek et al. ..... 57/58.89 X
3,404,524 10/1968 Rajnoha et al. ..... 57/81
4,163,358 8/1979 Takeuchi et al. ..... 57/263 X
4,288,975 9/1981 Yoshida et al. ..... 57/263

*Primary Examiner*—John Petrakes
*Attorney, Agent, or Firm*—Wenderoth, Lind & Ponack

[57] ABSTRACT

When an open end spinning machine is stopped, a fiber supply to a spinning rotor is first stopped and thereafter, substantially simultaneously with stoppage of both a yarn take-up roller and a yarn winding roller, a yarn end is held by a yarn holding device at a time when it still remains in a region which undergoes the suction effect of a subatmospheric pressure produced in the spinning rotor. The spinning rotor is subsequently stopped. On starting, the holding of the yarn end by the yarn holding device continues even after restarting of the spinning machine until the subatmospheric pressure produced in the spinning rotor reaches substantially the same value as that produced during a normal spinning operation. Therefore, there is prevented any snarling phenomenon, resulting in a greatly increased success rate in the operation of connecting yarn ends on re-starting of the spinning machine.

10 Claims, 4 Drawing Figures

METHOD AND APPARATUS FOR STARTING AND STOPPING AN OPEN END SPINNING MACHINE

BACKGROUND OF THE INVENTION

This invention relates generally to an open end spinning machine, and more particularly to the prevention of the occurrence of snarls in the yarn end present in a yarn take-up tube at the time when the spinning machine stops or starts to operate.

Generally, in an open end spinning machine such as, for example, described in U.S. Pat. No. 3,354,626, each spinning unit includes means for feeding individually opened fibers into a spinning rotor, in which subatmospheric pressure is produced by rotation thereof. The opened fibers are formed into a yarn in the spinning rotor. The yarn is transported from the spinning rotor by a take-up means including a yarn take-up tube and yarn take-up rollers and is wound on a bobbin by a winding means. Also, in the above open end spinning machine, each of the fiber feeding means, yarn take-up means and yarn winding means is mounted on a separate driving shaft and a single motor drives these separate driving shafts through a rotation transmission mechanism including trains of gears. This motor also drives an endless belt, which is in frictional contact with spindles of the spinning rotors to rotate the same.

When the spinning machine is stopped, the fiber feeding means is first stopped to discontinue the supply of fibers to the spinning rotor, the take-up roller and winding roller are then stopped at a time when the yarn end resulting from breakage of the yarn still remains in the yarn take-up tube which undergoes the suction effect of the subatmospheric pressure in the spinning rotor. Finally, all the spinning rotors are stopped. On starting, all the spinning rotors start to rotate simultaneously, the yarn take-up rollers and winding rollers are then rotated in a reverse direction to push the yarn ends from the take-up tubes into the spinning rotors, while the fiber feeding means are operated to supply the opened fibers into the spinning rotors thereby to allow them to be twisted into the reversed yarn ends. Thereafter, the take-up rollers and winding rollers are rotated in a normal, yarn winding direction.

With this stopping method, the rotation of the spinning rotors continues for a predetermined period of time even after the take-up rollers have stopped, and the rotating rotors can impose the suction effect thereof upon the yarn ends in the yarn take-up tubes. This causes each yarn end to be untwisted between the associated spinning rotor and take-up rollers so that the occurrence of snarls in the yarn end can be prevented to some extent. However, where the yarn end has been given a strong twist, the afore-mentioned suction effect of the spinning rotor may not satisfactorily prevent the yarn end from being snarled after the stop of rotation thereof and therefore the yarn end may shrink upwardly out of the yarn take-up tube. In such case, even when the spinning rotor is rotated before the rotation of the take-up roller and winding roller starts in the reverse direction, it is not possible to introduce the yarn end into the take-up tube and hence to the spinning rotor by the suction effect of the latter. Moreover, in the spinning machine as discussed above, since the untwisting of the yarn end is intended to be effected between the spinning rotor and the yarn take-up rollers, the length over which the yarn end is untwisted is such that yarn quality is adversely affected.

It is therefore a principal object of this invention to provide a method and apparatus for starting and stopping an open end spinning machine, which can significantly prevent the occurrence of snarls in the yarn end regardless of the degree of twist of the yarn and can limit the untwisted length of the yarn to a favourable value.

SUMMARY OF THE INVENTION

A control apparatus according to this invention includes, in addition to a power on-off switch, switches for stopping and starting an open end spinning machine. When the spinning machine is stopped, the stop switch is pushed down to stop each of the yarn taking up means, yarn winding means, and the supply of fibers to a spinning rotor, when yarn breakage occurs in the spinning rotor. The yarn end resulting from the breakage is held by a yarn holding lever before it moves out of a yarn take-up tube extending into the spinning rotor, the spinning rotor is then stopped after a predetermined period of time, during which the yarn end held by the yarn holding lever undergoes the suction effect of a subatmospheric pressure produced in the spinning rotor so that the yarn end is untwisted in the yarn take-up tube thereby preventing the occurrence of the snarling phenomenon whereby the yarn end shrinks up and comes out of the yarn take-up tube.

On starting, the start switch is operated to produce a signal indicating the re-starting of the spinning machine. The holding of the yarn end by the yarn holding lever continues until the spinning rotor reaches a sufficient speed to produce a subatmospheric pressure capable of stretching out the yarn end so that the latter can be prevented from being snarled in the yarn take-up tube. The yarn holding lever has a free end positioned adjacent to the yarn outlet end of the yarn take-up tube and the yarn end is adapted to be held by this end of the yarn holding lever so that the length of yarn untwisted by the suction effect of the spinning rotor can be reduced as compared with that of the prior art. This achieves good results with regard to yarn quality.

BRIEF DESCRIPTION OF THE DRAWINGS

This invention will become more readily understood from the following description of a preferred embodiment shown, by way of example only, in the accompanying drawings, wherein.

DESCRIPTION OF THE PREFERRED EMBODIMENT

Figure 1:
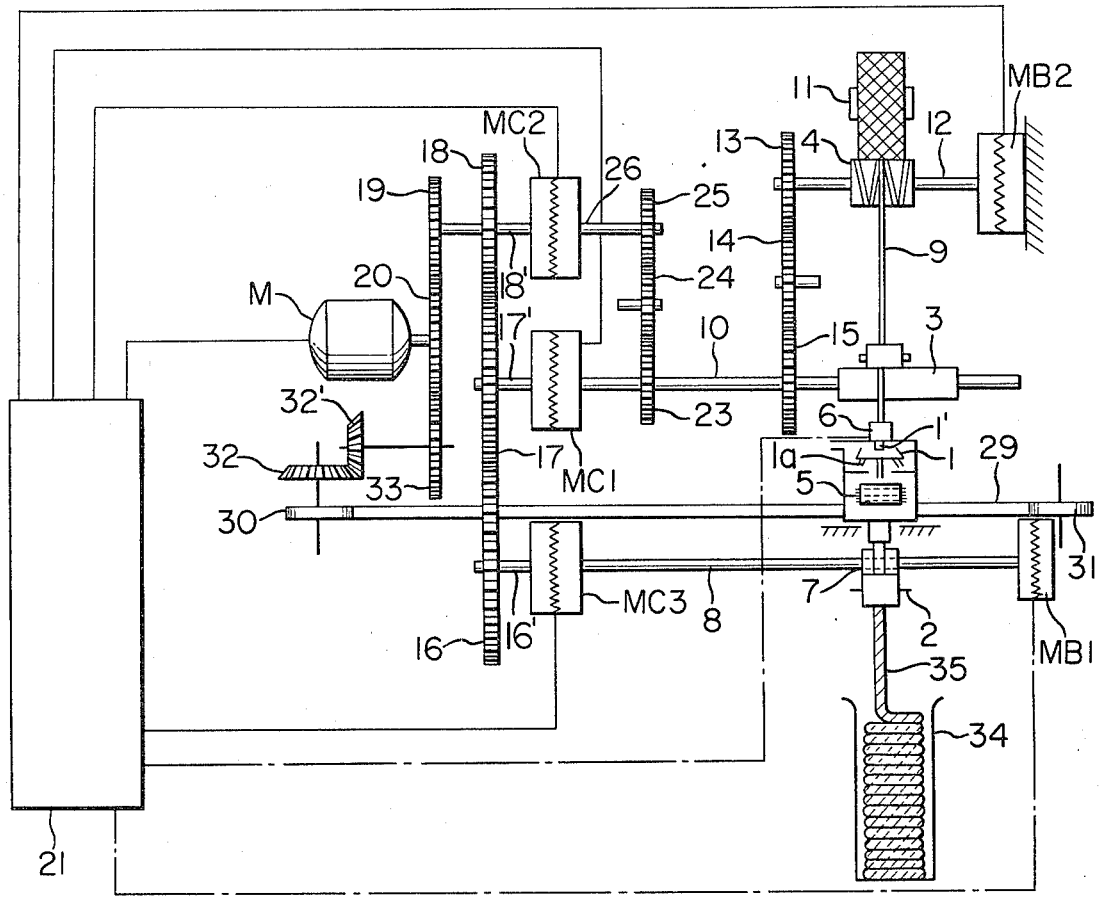
FIG. 1 is a fragmentary schematic view showing a portion of a prior art spinning machine to which this invention is applicable.

Referring to FIG. 1, there is shown a drive transmission mechanism of a prior open end spinning machine similar to that described in U.S. Pat. No. 3,354,626 and this invention can be applied to such a spinning machine. Although only one spinning unit is shown in FIG. 1, the spinning machine normally comprises a number of spinning units along each side of the spinning machine, and yarn ending operations are simultaneously effected in all the spinning units on starting the machine.

Each spinning unit comprises a spinning rotor 1 into which opened fibers are supplied and formed into a yarn 9, means for feeding a sliver or roving 35 from a can 34, means for opening the sliver 35 into the individual fibers and supplying them into the spinning rotor 1, means for taking up the yarn 9, and a winding roller 4 for winding the yarn 9 onto a bobbin 11. The feeding means comprises lower and upper feeding rollers 2 and 7 forming a nip therebetween, through which the sliver 35 is fed. The fiber opening and supplying means comprises a combing roller 5 of the well known type. The take-up means 3 includes a lower take-up roller and an upper take-up roller driven by the lower roller. The spinning rotor 1 may be of either the self-discharge type, wherein air in the interior of the spinning rotor is discharged through openings 1*a* provided in the bottom of the spinning rotor due to its rotation, or the forced-discharge type, wherein air in the interior of the spinning rotor is discharged through an intake system (not shown) disposed outside of the spinning rotor. In any case, a subatmospheric pressure is produced in the interior of the spinning rotor 1 during rotation and the individual fibers opened by the combing roller 5 are thereby drawn into the interior of the spinning rotor 1.

The take-up means further includes a yarn take-up tube 1' disposed between the take-up roller 3 and the spinning rotor 1 so as to be in air communication with the latter. As is well known, the individual fibers are twisted into the yarn end in the spinning rotor 1 and the resultant yarn 9 is taken up from the spinning rotor 1 through the take-up tube 1' by the take-up rollers 3. Although only one pair of take-up rollers 3 is shown, all the lower take-up rollers, equal in number to the number of spinning units, are mounted on a common driving shaft 10 mounted for rotation in the frame of the spinning machine. The winding roller 4, which has crossing grooves is in driving relationship with the bobbin 11 to wind a package thereon in a cross winding manner. All the winding rollers 4 of the spinning units are attached to a driving shaft 12 rotatably mounted in the machine frame and controlled by an electromagnetic brake MB2 in a manner as discussed below.

The driving shaft 12 is rotated through a train of gears 13, 14 and 15 by the driving shaft 10 in the same direction as the shaft 10.

Also, all the sliver feed rollers 7 are mounted on a common driving shaft 8 connected through a sliver feed electromagnetic clutch MC3 (hereinafter referred to as the "feed clutch") with a shaft 16' supporting a gear 16, which is driven through a train of gears 17, 18, 19 and 20 by an electric motor M and controlled by an electromagnetic brake MB1 as discussed below. The shaft 10 for driving the takeup rollers 3 is connected through an electromagnetic clutch MC1 with a shaft 17' supporting the gear 17. The clutch MC1 is hereinafter referred to as the "reverse clutch" because the yarn is fed in a reverse direction when the clutch MC1 is in engagement. To rotate the shaft 10 in a forward direction, the gear 18 supported by a shaft 18' is connected through an electromagnetic clutch MC2 and a train of gears 23, 24 and 25 with the shaft 10. The gear 23 is mounted on the shaft 10 so as to be positioned between the reverse clutch MC1 and the gear 15. The gear 23 meshes with the intermediate gear 24, which meshes in turn with the gear 25 supported by a shaft 26. The shaft 26 is connected to a driven member of the clutch MC2. The clutch MC2 is hereinafter referred to as the "forward clutch", because the yarn is fed in a forward direction when it is in engagement.

Mounted around a pair of pulleys 30 and 31 is an endless belt 29, which is in driving relationship with all the spinning rotors 1 in a conventional manner so that all the spinning rotors 1 are simultaneously rotated in the same direction. The pulley 30 is driven through a train of gears 32, 32', 33 and 20 by the motor M.

Therefore, it will be understood that in this embodiment all the spinning units are driven by the single motor M and their operation is controlled by controlling the motor M, forward clutch MC2, reverse clutch MC1, feed clutch MC3 and electromagnetic brakes MB1 and MB2 by means of a control apparatus 21. The apparatus 21 also controls yarn holding devices 6 each disposed adjacent to the respective take-up tube 1' and forming a part of the stopping and starting apparatus according to this invention.

Figure 2:
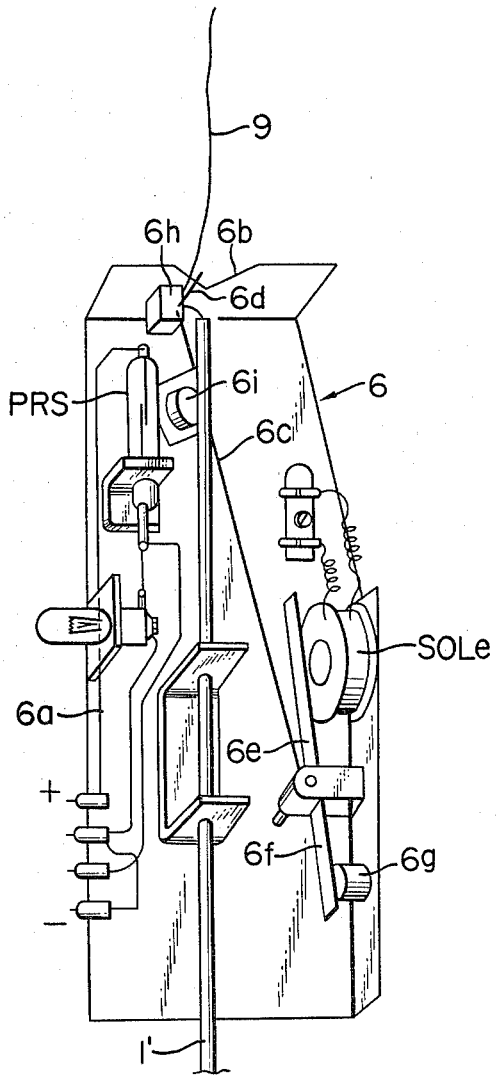
FIG. 2 is a perspective view of a yarn holding device employed in the embodiment of this invention.
Figure 3A:
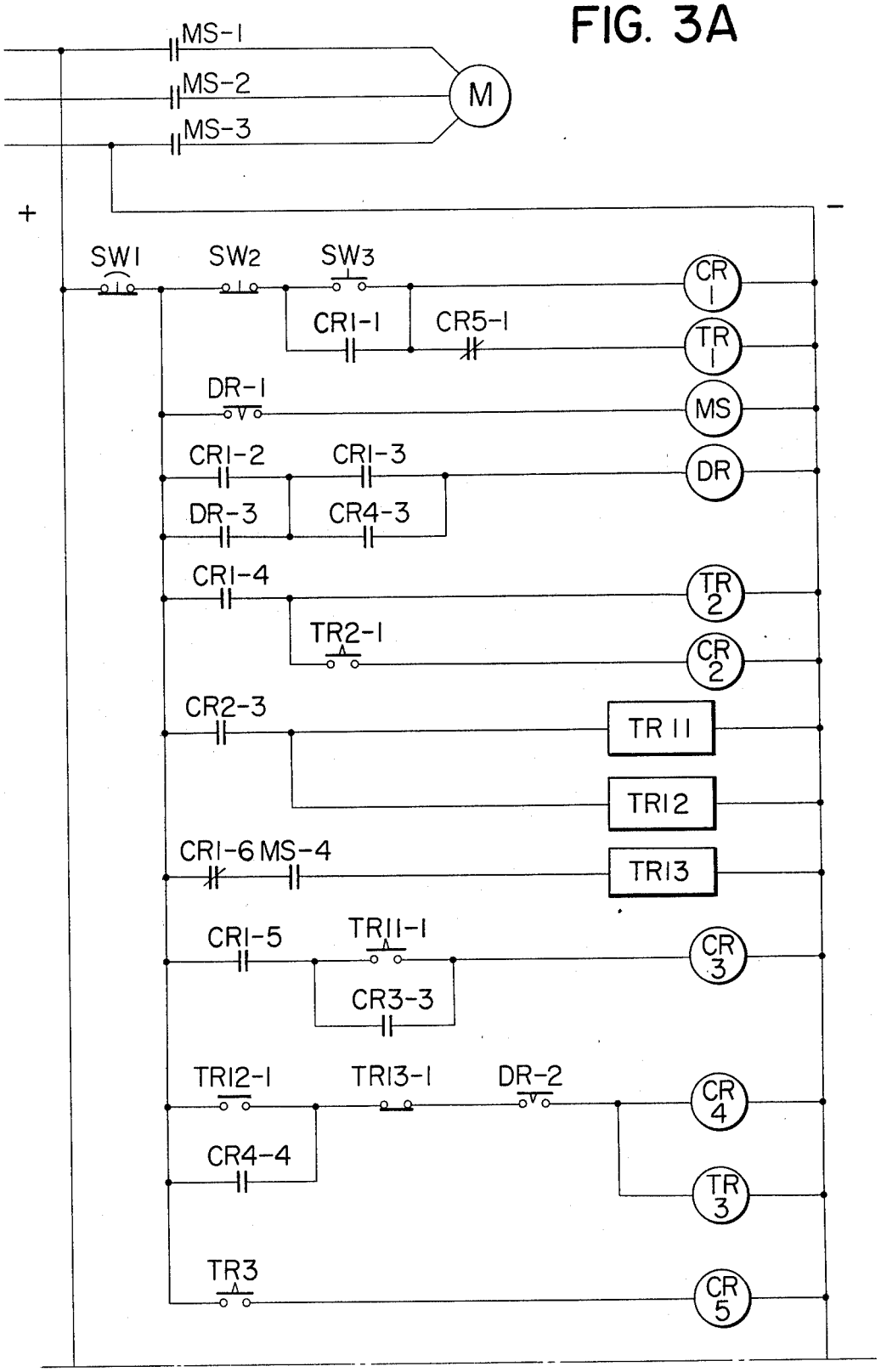
FIGS. 3A and 3B illustrate a suitable electric circuit for operating an apparatus in accordance with this invention.
Figure 3B:
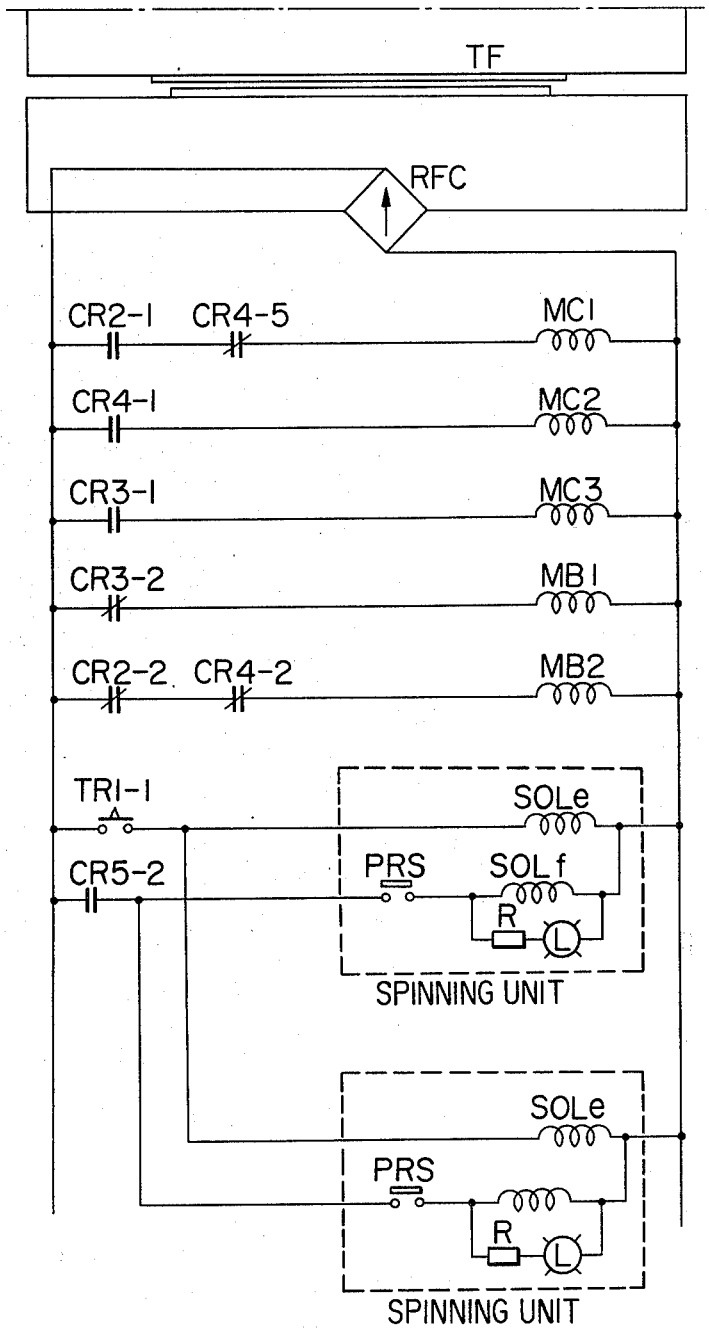

Details of the yarn holding device 6 and the control apparatus are shown respectively in FIG. 2 and FIGS. 3A and 3B. In FIG. 2, there is shown a yarn breakage sensing device, which is similar to that disclosed in British Pat. No. 1,158,623 and also available as the yarn holding device 6. The sensing device includes a base plate 6*a* provided with a V-shaped guide notch 6*b*, adjacent to which the upper end of the take-up tube 1' extends upwardly, and a yarn holding lever 6*c* pivotably connected with the base plate 6*a*. The yarn holding lever 6*c* is provided with oppositely extending plate-like arms 6*e* and 6*f* made of suitable known ferromagnetic material and associated respectively with an electromagnet SOLe and a permanent magnet 6*g*. When the magnet SOLe is energized, it attracts the arm 6*e* and causes the lever 6*c* to turn from a yarn holding position (shown in FIG. 2) into the righthandmost position (not shown). In the yarn holding position, the lever 6*c* abuts at its upper end 6*d* against an elastic support block 6*h* to hold the yarn 9 therebetween. When the lever 6*c* turns toward the yarn holding position, the lower arm 6*f* is attracted by the permanent magnet 6*g* thereby to urge the lever 6*c* into the yarn holding position. This ensures that the lever 6*c* provides an increased pressure against the support block 6*h* to firmly hold the yarn 9.

When the spinning machine is stopped, the fiber feeding means is first stopped to discontinue the supply of fibers to the spinning rotors in accordance with this invention. At that time, yarn breakage occurs in each of the spinning rotors or a lowering of tension of the yarn occurs due to the discontinuance of fiber supply and therefore the lever 6*c* is turned into the yarn holding position in which its end 6*d* elastically holds the yarn end in cooperation with the support block 6*h* before the yarn end moves out of the take-up tube 1'. On re-starting of the spinning machine, when the suction effect provided by the rotation of the spinning rotor attains a sufficient level to prevent the occurrence of snarls in the yarn end in the take-up tube 1', the electromagnet SOLe is energized under the control of the control apparatus 21 as described in detail hereinafter, whereupon the electromagnet SOLe attracts the upper arm 6*e* against the action of the permanent magnet 6*g*, this causing the yarn end held by the lever 6*c* to be released.

A suitable form of the control apparatus 21 and its operation are described below in conjunction with FIGS. 3A and 3B.

The vertical lines labelled respectively with a plus symbol (+) and a minus symbol (−) represent the positive and negative sides of a source of current, and the various elements constituting the control apparatus 21 in this embodiment of the invention are connected in the manner shown in FIGS. 3A and 3B. A power on-off switch $SW_1$, stop pushbutton $SW_2$ and start pushbutton $SW_3$ are in series with each other. These switches are in the on state, i.e., closed during spinning operation of the spinning machine.

When the spinning machine is stopped, the stop pushbutton $SW_2$ is turned off, with the pushbuttons $SW_1$ and $SW_3$ maintained in the on state whereupon a control relay CR1 is deenergized to open its normally open contacts CR1-1 to CR1-5 and to close its normally closed contacts CR1-6. Because the contacts CR1-2 and CR1-3 are brought into the off state, an off timer DR for causing a delayed stop of the driving motor M starts to count a set time. Also, by the opening of contacts CR1-5, a relay CR3 is deenergized to open the normally open contacts CR3-1 and close the normally closed contacts CR3-2, whereby the supply clutch MC3 and supply brake MB1 both connected to the shaft 8 (FIG. 1) are brought into the off state and on state respectively, stopping the supply of fibers. As a result, the yarn holding lever **6*c*, which has been maintained in a yarn sensing position between the yarn holding position shown in FIG. 2 and the righthandmost position by the tension of the yarn 9 during spinning operation, is turned to the yarn holding position by the assistance of the permanent magnet 6*g* attracting the lower arm 6*f* thereto when yarn breakage or reduction of yarn tension occurs due to the discontinuance of fiber supply. Thus, the yarn can be elastically held between the end 6*d* of the yarn holding lever 6*c* and the elastic support block 6*h* so that the occurrence of snarls can be prevented. On the other hand, since the normally closed contacts CR1-6 of the relay CR1 are closed simultaneously with the opening of the normally open contacts of the same, a timer or time counter TR13 for a delayed operation of the electromagnetic brake MB2 associated with the winding shaft 12 starts to count to a set time. When it counts up the set time, the normally closed contacts TR13-1 cause a control relay CR4 to be deenergized, whereupon the normally open contacts CR4-1 are opened to bring the forward clutch MC2 into the off state and the normally closed contacts CR4-2 are closed to bring the winding shaft brake MB2 into the on state. Thus, both the take-up rollers 3 and winding rollers 4 are stopped. At that time, the driving motor M remains rotated and accordingly the spinning rotors also rotate thereby to cause the yarn ends in the take-up tubes 1' to undergo the suction effect thereof. However, when the timer DR for the delayed stop of the motor M, which timer has started to count to the set time through the push down of the stop pushbutton $SW_2$, counts up the set time, its normally closed contacts DR-1 are opened to deenergize a motor switch relay MS thereby to open contacts MS-1, MS-2 and MS-3. Thus, the driving motor M is sopped, resulting in a delayed stop of the spinning rotors 1**.

When the spinning machine is re-started from the above-discussed stop condition, both the start and stop switches $SW_3$ and $SW_2$ are operated to close the circuit. Because of this, the control relay CR1 is deenergized to close the normally open contacts CR1-1, whereupon a timer TR1 starts to count to a set time, at which the electromagnets SOLe are energized to attract the upper arms **6*e* of the yarn holding levers 6*c* thereto to maintain the yarn holding levers 6*c* in their righthandmost position. Simultaneously the contacts CR1-2 and CR1-3 are closed to close the normally closed contacts DR-1 of the off timer DR, whereby the motor start relay MS is energized to close the contacts MS-1, MS-2 and MS-3. Thus, the driving motor M is operated and accordingly the spinning rotors 1 start to rotate. The set time of the timer TR1, which becomes operative simultaneously with the commencement of rotation of the spinning rotors 1, is so selected as to correspond to a period of time, at least by the end of which the spinning rotors 1 are caused to attain a sufficient speed to apply the suction effect thereof to the yarn ends in the take-up tubes 1' thereby to satisfactorily stretch out the same. Therefore, it will be understood that no snarls would occur in the yarn ends even after they are released from the associated holding levers 6*c* by the attraction of the magnets SOLe on the upper arms 6*e* of the yarn holding levers 6*c* when the set time of the timer TR1** elapses.

Moreover, simultaneously the contacts CR1-4 of the relay CR1 are closed to cause a timer TR2 to start to count to a set time, at which the take-up rollers and winding rollers are to be rotated in a reverse direction. The set time of the timer TR2 is preferably slightly longer than that of the timer TR1 so that the yarn ends can be fed back into the spinning rotors after they have been satisfactorily stretched out by the suction effect of the spinning rotors. When the time TR2 counts up the set time, its contacts TR2-1 close to energize a control relay CR2. Therefore, the normally open contacts CR2-1 of the relay CR2 are closed to energize the reverse clutch MC1 while the normally closed contacts CR2-2 are opened to deenergize the winding shaft brake MB2, whereby the take-up rollers 3 and winding rollers 4 are rotated in a reverse direction and the sufficiently untwisted yarn ends can be pushed into the spinning rotors 1.

Also, simultaneously the contacts CR2-3 of the relay CR2 are closed to cause a timer TR11 to start to count to a set time, at which the feed clutch MC3 is energized. When the timer TR11 counts up the set time, its contacts TR11-1 are closed to energize a relay CR3, whereby the contacts CR3-1 are closed to energize the feed clutch MC3 while the contacts CR3-2 are opened to deenergize the brake MB1. Thus, the sliver supply to each of the spinning units begins. The sliver 35 is fed by the feeding means to each combing roller 5 by which it is opened into individual fibers. The individual fibers are then fed into the spinning rotor 1 and twisted into the yarn end fed back in the aforementioned manner into the spinning rotor.

Furthermore, simultaneously with the closing of the contacts CR2-3, a timer TR12 for setting a time at which the forward clutch MC2 is to be energized, starts to count to a set time. When the set time of the timer TR12 elapses, its normally open contacts TR12-1 close to energize both a control relay CR4 and a timer TR3 through the normally closed contacts TR13-1 of a timer TR13 for setting a time of energization of the winding shaft brake and the normally closed contacts DR-2 of the off timer DR for the delayed stop of the driving motor M. Upon energization of the relay CR4, the normally open contacts CR4-1 close to energize the forward clutch MC2 while the normally closed contacts CR4-2 and CR4-5 open to deenergize both the winding shaft brake MB2 and the reverse clutch MC1. Thus, the take-up rollers 3 and winding rollers 4 are rotated in a forward direction so that the pulling out of the yarn 9 can be effected at a proper timing with respect to the connection of the yarn end with the fibers collected in the spinning rotor.

After the forward rotation of both the take-up rollers 3 and winding rollers 4 starts to pull out the yarns 9 from the spinning rotors, the timer TR3 counts up the set time, when its contacts TR-3 close to energize a control relay CR5. Simultaneously the normally closed contacts CR5-1 are opened and therefore the contacts TR1-1 of the timer TR1 are also opened thereby causing the electromagnets SOLe, which have attracted the upper arms 6e of the yarn holding levers 6c, to be deenergized to allow the yarn holding levers 6c to turn into and be maintained by the yarn tension in their yarn sensing position, in which their ends 6d contact the spun yarns 9 during the normal spinning operation.

When either a yarn breakage or an abnormal lowering of yarn tension of a level insufficient for maintaining the yarn holding lever 6c in the yarn sensing position occurs in any spinning unit, the lever 6c involved is turned to the yarn holding position as shown in FIG. 2 so that a permanent magnet 6i mounted on the lever 6c approaches a reed switch PRS. At that time, the reed switch PRS is turned since the normally open contacts CR5-2 have been closed upon energization of the relay CR5. The closing of both the contacts CR5-2 and the reed switch PRS cause an electromagnet $SOL_f$ to be energized, whereby a feed clutch (not shown), provided for each spinning unit in association with the fiber feed means 2 thereof and normally held in the off state, is turned to the on state to discontinue the fiber supply to the spinning unit involved in the yarn breakage.

Although the lever 6c of the yarn holding device 6 in this embodiment of the present invention combines the functions of yarn holding and yarn break sensing, the yarn break sensing may be carried out by a separate device.

It will be apparent from the foregoing that according to this invention, the snarling phenomenon which inevitably occurs in conventional spinning machines is prevented, resulting in a greatly increased success rate in the operation of connecting yarn ends at the re-starting of the spinning machine, because, when the spinning machine is stopped, the fiber supply to the spinning rotors is stopped and thereafter, substantially simultaneously with the stopping of the take-up rollers and winding rollers, the yarn ends are held by the corresponding yarn holding devices at a time when they still remain in the region which undergoes the suction effect of the subatmospheric pressure produced in the spinning rotors, which are subsequently stopped, and even after restarting of the spinning machine, the holding of the yarn ends by the corresponding yarn holding devices continues until the subatmospheric pressure produced in the spinning rotors by the rotation thereof reaches substantially the same level as that produced during a normal spinning operation.

Although a single preferred embodiment has been described above, it will be readily understood by those skilled in the art that this invention is applicable to other open end spinning machines having different construction. For example, the spinning machine may employ a single electromagnetic clutch in lieu of the reverse and forward clutches MC1 and MC2. Also, the spinning rotors may be driven by a separate motor independent of the motor M, and the feeding of the yarn end in the reverse direction may be carried out by storing up an additional length of yarn between the take-up roller 3 and the take-up tube 1 when the spinning machine is stopped and releasing the stored yarn when it is necessary to feed the yarn end in the reverse direction, whereupon the released yarn is sucked into the spinning rotor by the subatmospheric pressure produced therein.

What we claim is:

1. In a method of operating an open end spinning machine of the type including a spinning rotor, means for supplying opened fibers into said spinning rotor, means for rotating said spinning rotor and thereby for forming said fibers into a yarn, means for creating a subatmospheric pressure in said spinning rotor during rotation thereof, a yarn take-up tube extending into said spinning rotor, means for taking-up said yarn through said yarn take-up tube from said spinning rotor, and means for winding the taken-up yarn onto a bobbin, said method of operating said spinning machine comprising stopping said spinning machine, thereby resulting in a free end of said yarn, and thereafter starting said spinning machine while connecting the leading end of newly formed yarn to said free end, the improvement of conducting said stopping and starting in a manner to prevent the occurrence of snarls in said free end regardless of the degree of twist in said yarn and to limit the length of said free end which becomes unraveled, said improvement comprising:

upon stopping said spinning machine:

stopping said fiber supplying means and thereby stopping the supply of fibers to said spinning rotor;

thereafter stopping said yarn taking-up means and said winding means, and simultaneously holding said yarn at a position adjacent a yarn outlet end of said yarn take-up tube and maintaining said free end within said yarn take-up tube; and thereafter stopping rotation of said spinning rotor and removing the effect of said subatmospheric pressure within said spinning rotor and within said yarn take-up tube and acting on said free end; and upon starting said spinning machine:

starting rotation of said spinning rotor and producing said subatmospheric pressure;

maintaining said free end held at said position and in said yarn take-up tube until said subatmospheric pressure in said spinning rotor and said yarn take-up tube reaches a level sufficient to prevent the occurrence of snarls in said free end, and thereby limiting the length of said free end which becomes unraveled;

then releasing said free end;

operating said yarn taking-up means and said winding means in a direction opposite to normal operation of said spinning machine and thereby pushing said free end into said spinning rotor;

starting said fiber supplying means to feed fibers to said spinning rotor, thereby forming new yarn, and connecting the leading end of said new yarn to said free end; and then operating said yarn taking-up means and said winding means in the direction of normal operation.

2. The improvement claimed in claim 1, wherein said removing and producing of the effect of said subatmospheric pressure are carried out respectively by stopping and rotating said spinning rotor.

3. The improvement claimed in claim 1, wherein said removing and producing of the effect of said subatmospheric pressure are carried out respectively by energizing and deenergizing an intake system disposed outside of said spinning rotor.

4. In an open end spinning machine of the type including a spinning rotor associated with means for producing therein a subatmospheric pressure, means for supplying opened fibers into said spinning rotor, means for rotating said spinning rotor and thereby for forming said fibers into a yarn, a yarn take-up tube extending into said spinning rotor, means for taking-up said yarn through said yarn take-up tube from said spinning rotor, and means for winding the taken-up yarn onto a bobbin, said spinning machine being capable of being stopped, resulting in a free end of said yarn, and thereafter started, while connecting the leading end of a newly formed yarn to said free end, the improvement comprising means for, upon stopping and subsequent starting of said spinning machine, preventing the occurrence of snarls in said free end regardless of the degree of twist in said yarn and limiting the length of said free end which becomes unraveled, said preventing and limiting means comprising:

holding means positioned adjacent an outlet end of said yarn take-up tube for holding said yarn; and control means operatively connected for controlling the operation of said holding means, said subatmospheric pressure producing means, said fiber supplying means, said yarn taking-up means, and said winding means in accordance with a predetermined time sequence such that when said spinning machine is stopped:

said fiber supplying means is first stopped;

thereafter said yarn taking-up means and said winding means are stopped, while simultaneously said holding means operates to hold said yarn at said position and to maintain said free end in said yarn take-up tube; and thereafter said subatmospheric pressure producing means is stopped to remove the effect of the subatmospheric pressure from within said spinning chamber and within said yarn take-up tube; and such that when said spinning machine subsequently is started:

said subatmospheric pressure producing means is started to produce the subatmospheric pressure;

said holding means is maintained holding said yarn at said position with said free end in said yarn take-up tube until said subatmospheric pressure in said spinning rotor and in said yarn take-up tube reaches a level sufficient to prevent the occurrence of snarls in said free end, thereby limiting the length of said free end which becomes unraveled;

then said holding means releases said yarn;

said yarn taking-up means and said winding means are operated in a direction opposite to normal operation of said spinning machine to push said free end into said spinning rotor;

said fiber supplying means is operated to feed fibers to said spinning rotor, and the leading end of a new yarn is connected to said free end; and then said yarn taking-up means and said winding means are operated in the direction of normal operation.

5. The improvment claimed in claim 4, wherein said subatmospheric pressure producing means comprises a plurality of through holes provided in said spinning rotor.

6. The improvement claimed in claim 4, wherein said subatmospheric pressure producing means comprises an air intake system disposed outside of said spinning rotor and in air communication with the inside thereof.

7. The improvement claimed in claim 4, wherein said holding means comprises an elastic support block disposed adjacent said yarn outlet end of said yarn take-up tube, and a yarn holding lever mounted for pivotal motion between a yarn holding position, at which said yarn holding lever at its free end engages with said support block to hold said yarn therebetween, and a yarn releasing position, at which said yarn holding lever is disengaged from said support block.

8. The improvement claimed in claim 7, wherein said yarn holding lever turns to said yarn holding position past a yarn break sensing position in which said yarn holding lever contacts the yarn during normal spinning operation of said spinning machine so as to be held in said yarn break sensing position by the tension of the yarn.

9. The improvement claimed in claim 7, wherein said holding means further comprises a permanent magnet capable of attracting said yarn holding lever to bring it into said yarn holding position, and said control means comprises an electromagnet operatively associated with said yarn holding lever so that upon energization thereof said yarn holding lever is attracted by said electromagnet against the attraction of said permanent magnet, thereby to turn said yarn holding lever to said yarn releasing position.

10. The improvement claimed in claim 9, wherein said control means further comprises a start pushbutton for starting said spinning machine and accordingly said spinning rotor, and a timer connected in series to said start pushbutton and having contacts connected in parallel to said electromagnet, said contacts being closed to energize said electromagnet when said timer counts up a set time which is so determined that said spinning rotor attains a sufficient speed to produce said sufficient subatmospheric pressure when said set time elapses.

* * * * *